US011933056B1

(12) United States Patent
Perugini

(10) Patent No.: US 11,933,056 B1
(45) Date of Patent: Mar. 19, 2024

(54) TILE LEVELING DEVICE AND METHOD FOR USING THE SAME

(71) Applicant: Rocco Perugini, Bethlehem, PA (US)

(72) Inventor: Rocco Perugini, Bethlehem, PA (US)

( * ) Notice: Subject to any disclaimer, the term of this patent is extended or adjusted under 35 U.S.C. 154(b) by 0 days.

(21) Appl. No.: 18/235,038

(22) Filed: Aug. 17, 2023

(51) Int. Cl.
*E04F 21/22* (2006.01)

(52) U.S. Cl.
CPC ..... *E04F 21/22* (2013.01)

(58) Field of Classification Search
CPC ... E04F 21/22; E04F 21/1844; E04F 21/0092; E04F 21/0892; E04F 13/0892; E04F 15/02005
See application file for complete search history.

(56) References Cited

U.S. PATENT DOCUMENTS 5,363,560 A 11/1994 Makow

FOREIGN PATENT DOCUMENTS

WO WO-2004106665 A1 * 12/2004 ..... E04F 13/0885
WO WO-2005122667 A2 * 12/2005 ..... E04F 15/02027
WO WO-2013023235 A1 * 2/2013 ..... E04F 21/1877

* cited by examiner

*Primary Examiner* — Babajide A Demuren
(74) *Attorney, Agent, or Firm* — IP Works Law, PLLC

(57) ABSTRACT

A tile leveling device and a method for using the same is shown and described. The method for using a tile leveling device begins by placing at least one tile leveling device beneath a tile to be laid. In one instance the at least one tile leveling device is comprised of a malleable metal material. After the at least one tile leveling device is placed a tile is then set on top of the at least one tile leveling device. The tile is then leveled. When the tile is placed the tile leveling device is left under the tile and there is no need to remove the device.

11 Claims, 3 Drawing Sheets

TILE LEVELING DEVICE AND METHOD FOR USING THE SAME

BACKGROUND OF THE INVENTION

The present invention relates to laying tiles in a level manner without having to remove the leveling device. More particularly, the present invention provides a device which can be used to level tiles when they are being laid and removes the chance of shifting.

Laying tile can be either expensive or time consuming or both. In some cases, tiles can be difficult to lay in a manner where they are level. This can be due to any multitude of factors. However, some of these factors include tiles settling into tile mortar before the tile mortar has a chance to dry. Large tiles can weigh several pounds or more. It is possible that this weight will cause the tile to shift. Therefore, it is possible no matter how much work and precaution is taken to lay a level floor.

In some instances, various leveling equipment can be used in order to ensure the floor stays level. However, the current equipment has many drawbacks over the present invention. First, much of this equipment includes several parts. For example, there is a first part that is placed under the tile, then there is a second part which is connected to the first part. In some instances, there is a third part connected to the second part above the tile.

When used the first part is placed under the tile, the second part is then connected. The tile is then laid. After the tile is in place, the third part is connected to the second part. In some instances, the equipment can be manipulated by hand in order to level the tile. In other instances, the equipment requires a tool to level the tile. The tile mortar must then be allowed to set. After which time the second and third part must then be removed. This process can add significant time and labor cost to a job. Further, if the tiles are to be placed flush together many of these pieces of equipment will not work because they must stick between a gap in the tiles.

Tiles are currently and regularly being manufactured in larger and larger sizes. Surprisingly a 12 inch by 24-inch tile is actually considered small in today's market. While these larger sizes mean fewer tiles are needed to cover a surface, these larger sizes mean tiles can weight in excess of 20 pounds. With tiles that have this kind of weight even if the tiles are level when they are set it is highly likely that the weight will cause them to shift the tile mortar before it has had time to harden. This shifting can result in broken tiles or in tiles that are unlevel. When a tile is unlevel it will likely have an edge with rises above another adjacent tile creating a lip. This lip can be unsightly at best and worse a tripping hazard.

Consequently, there is a need for an improvement in the art of laying tile. The present invention substantially diverges in design elements from the known art while at the same time solving a problem many people face when laying tile and attempting to reduce the budget on a large tile job. In this regard the present invention substantially fulfills these needs.

SUMMARY OF THE INVENTION

The present invention provides a tile leveling device and a method for using the same wherein the same can be utilized for providing convenience for the user when using a tile leveling device. The method for using a tile leveling includes placing at least one tile leveling device beneath a tile to be laid. In one example, the at least one tile leveling device is comprised of a malleable metal material. Next a tile is placed on top of the at least one tile leveling device. The tile then must be leveled. When the process is completed, the tile leveling device is left under the tile.

Another object of the method for using a tile leveling device is to level the tile by applying pressure above the at least one tile leveling device.

Another object of the method for using a tile leveling device is to apply tile mortar to a subfloor prior to placing the at least one tile leveling device.

Another object of the method for using a tile leveling device is to lay the tile over the tile mortar, before placing the at least one tile leveling device. In this instance the tile is then lifted to check the coverage of the tile mortar along the tile.

Another object of the method for using a tile leveling device is to place an additional at least one tile leveling device beneath the a next tile to be laid. Then place a second tile on top of the additional at least one tile leveling device.

Another object of the method for using a tile leveling device is to repeat the method until the floor is laid and the project is complete.

Another object of the method for using a tile leveling device is to have the least one tile leveling device be a spherical device.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1A:
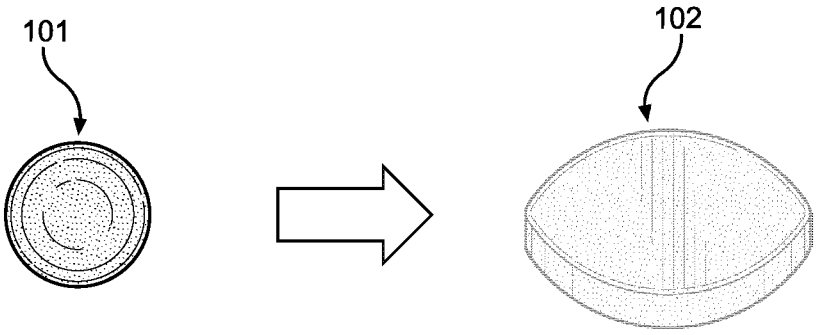
FIG. 1A shows a front view of one embodiment of a tile leveling device.

With regard to the reference numerals used, the following numbering is used throughout the drawings.

| | |
|---|---|
| 101 | Tile leveling device |
| 102 | Flattened tile leveling device |
| 201a | First tile |
| 201b | Second tile |
| 202 | Tile mortar |
| 203 | Subfloor |
| 301 | Spread tile mortar |
| 302 | Lay tile |
| 303 | Check Coverage |
| 304 | Apply tile leveling device |
| 305 | Lay tile |
| 306 | Level tile |
| 307 | Project Complete |
| 308 | Apply tile mortar |

DETAILED DESCRIPTION OF THE INVENTION

Reference is made herein to the attached drawings. Like reference numerals are used throughout the drawings to depict like or similar elements of the tile leveling device and a method for using the same. For the purposes of presenting a brief and clear description of the present invention, a preferred embodiment will be discussed as used for the tile leveling device and a method for using the same. The figures are intended for representative purposes only and should not be considered to be limiting in any respect.

Figure 1B:
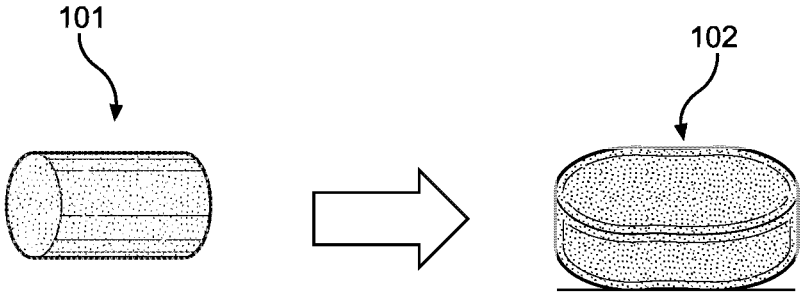
FIG. 1B shows a front view of one embodiment of a tile leveling device.

Referring now to FIG. 1A and FIG. 1B, there are shown front views of embodiments of a tile leveling device. In different embodiments the tile leveling device comes in different shapes and sizes. FIG. 1A and FIG. 1B show two examples of the tile leveling device 101, however, they are not meant to be limitations of the tile leveling device. Further, the tile leveling device may come in various sizes, meaning length, widths, heights, and/or diameters as required by tile laying jobs.

In different embodiments the tile leveling device 101 may also come in different shapes. In one embodiment the tile leveling device 101 is a sphere. When in use the sphere will be flattened into an oval shaped item. In another embodiment the tile leveling device 101 is a cylinder. In this embodiment the cylinder may also be flattened out in the leveling process. The cylinder may then change into an oval or a flatter cylinder.

In various embodiments the tile leveling device is made from different materials. In one embedment the tile leveling device 101 is made from a metal material. In this embodiment the metal is a malleable material and can be reshaped. In another embodiment the tile leveling device 101 is made from a plastic material. In this embodiment the plastic material is moldable. This will allow for the material to be shaped as needed. The material is capable to being shaped but it is not so ease to shape that the weight of a tile will misshape the device when the tile is laid in tile mortar.

In these FIGs. The tile leveling device 101 is shown in a first non-compacted or mishappen view. When in use the tile leveling device 101 is deformed as represented by the tile leveling device 102. The tile leveling device 102 is only a representation of the final shape of such a device. The tile leveling device is designed such that it may be reshaped with the application of reasonable force such that a tile which is laid on top of the tile leveling device 101 may be leveled. For the purposes of this disclosure reasonable force means a force which may be applied with a human hand. The force may be a steady force or a force which is applied by hitting or tapping a top side of a tile.

In different embodiments the tile leveling device 101 may come in a variety of shapes, sizes and colors. One of ordinary skill in the art will understand that changes to these characteristics will not significantly depart from the nature of the invention. For example purposes, the tile leveling device 101 may be produced in a variety of sizes. In the examples of these FIGs this means that the diameters of the tile leveling devices 101 may come in varying sizes. These sizes may be ⅜ of an inch to 1 inch. In one embodiment they may come in sizes outside of these dimensions. Further, other sizes may be produced, for example ¼ inch and ½ inch.

In one embodiment the color of the tile leveling devices 101 may not be relevant to the device in any manner. However, in another embodiment the color may add significant information to the nature of the tile leveling device 101. In this embodiment the color is used to represent the size of the device. For example, in one embodiment the color red may be used to represent a tile leveling device 101 with a diameter or ⅓ of an inch and a blue tile leveling device 101 may be used to represent a ½ in diameter.

Figure 2:
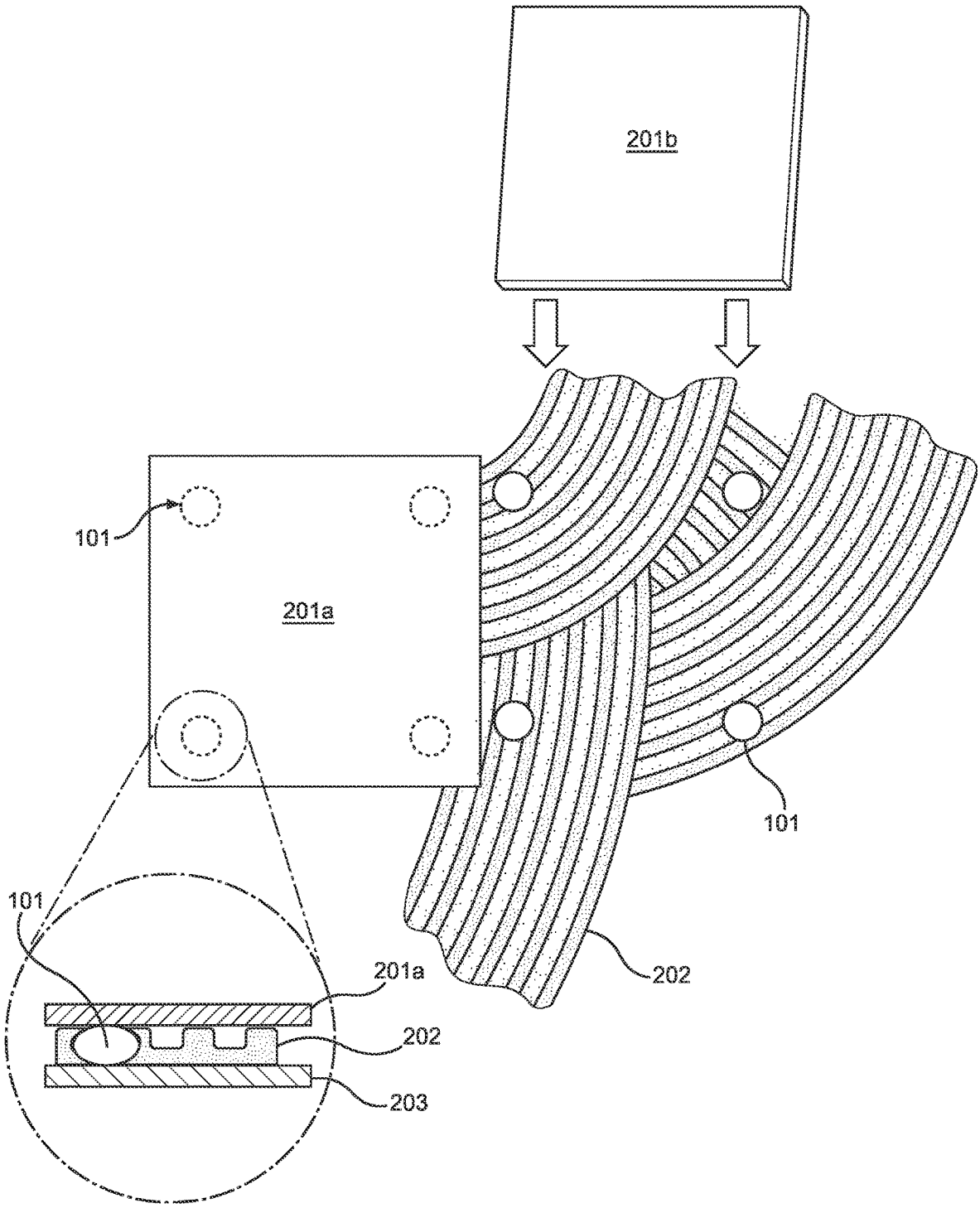
FIG. 2 shows a perspective view of an embodiment of the use for the tile leveling device.

Referring now to FIG. 2, there is shown a perspective view of an embodiment of the use for the tile leveling device. In use at least one tile leveling device 101 may be placed under a first tile 201*a* and left in place for the life of the tile project. In use a layer of tile mortar 202 is placed over a prepared subfloor 203. The first tile 201*a* is then placed on top of the tile mortar and the at least one tile leveling device 101. Once placed the first tile 201*a* is then leveled by applying force to the top of the first tile 201*a*. The at least one tile leveling device 101 will allow for a change in shape which will allow for the first tile 201*a* to remain level.

After the first tile 201*a* is leveled and in place the process starts over again. More tile mortar 202 is placed on the subfloor 203. Next, at least one tile leveling device 101 is placed in the tile mortar 202. In the shown embodiment four tile leveling devices 101 are used. By placing one in each corner of a tile the tile can be adjusted from any of the corners of the tile. This prevents the need to over deform a single device.

After the at least one tile leveling device 101 is placed in the tile mortar 202 the next tile 201*b* is placed thereon. In many embodiments the tile 201*b* will start out in a position higher than the first tile 201*a*. The second tile 201*b* is then flushed with the first tile 201*a*, or the preceding tile, and made level. In one embodiment, in order to level the tile pressure is applied to a top surface of the tile over where the tile leveling devices 101 are placed. Once the tile 201*b* is flushed it is leveled with the first tile 201*a*. This process repeats creating a level floor. Further, the tile leveling devices are left in place. This prevents the tiles from shifting as the tile mortar dries. Since the tile leveling device 101 remains in place there are no additional steps where the tile leveling device needs to be removed.

Figure 3:
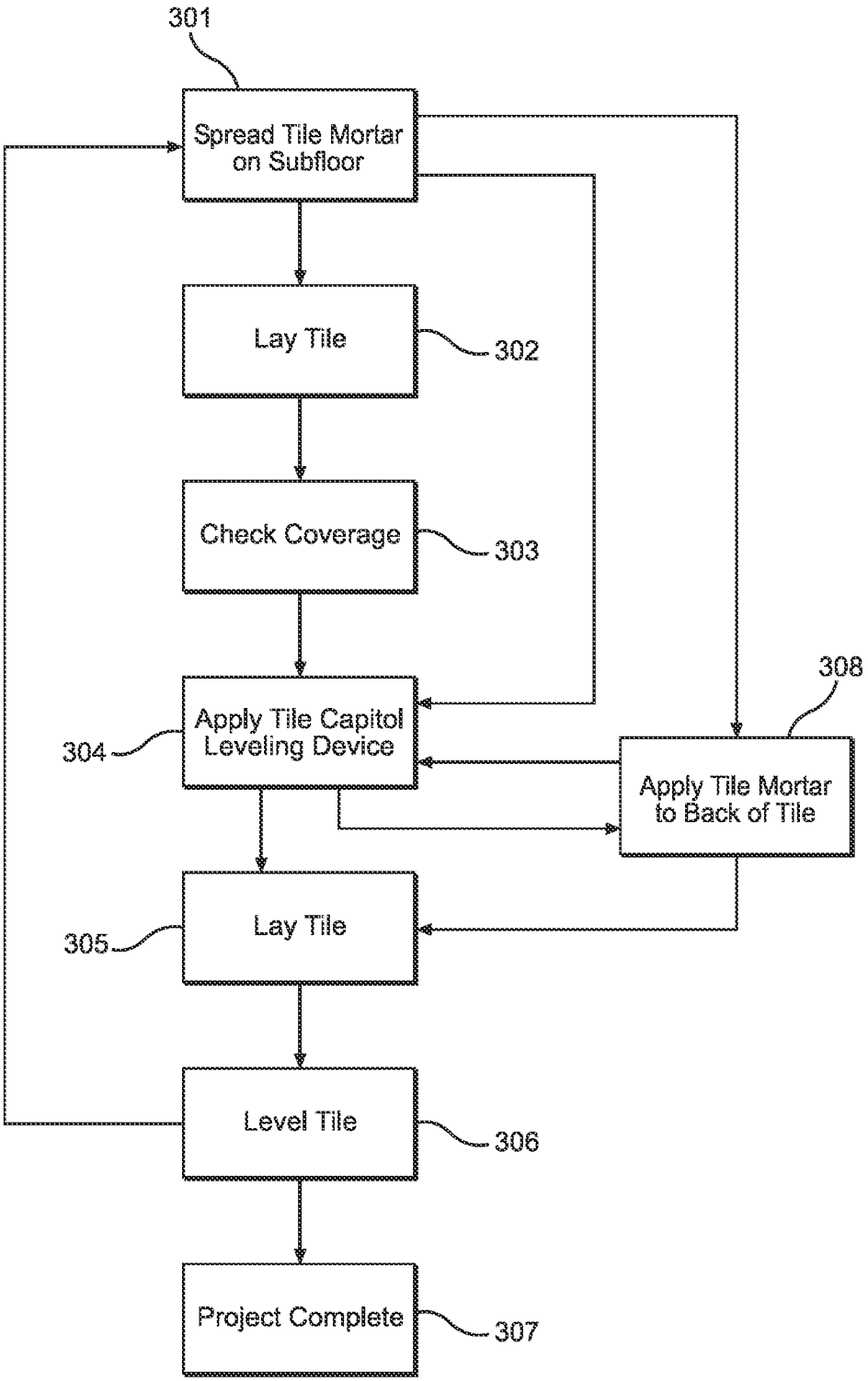
FIG. 3 shows a flow chart for an embodiment of a method of use for the tile leveling device.

Referring now to FIG. 3, there is shown a flow chart for an embodiment of a method of use for the tile leveling device. In use the tile leveling device removes several steps that are otherwise usually required to level tiles. Further, the devices do not have to be removed from the floor after the tile is leveled and the tile mortar is dried in place.

The process begins like any other tile laying job. For the purpose of this disclosure one of ordinary skill in the art will understand that there may be many different ways to prepare the subfloor for a tile laying project. For the purpose of this disclosure the method will begin after the subfloor has been prepared and the tile is ready to be put down. The method like any other tile laying project, with the spreading of tile mortar on the subfloor 301. In one embodiment an installer may skip straight to placing the tile leveling device directly in the tile mortar 304. However, in another embodiment the installer lays a tile in the tile mortar 302. The installer then checks the coverage of the tile mortar 303. In some embodiments additional tile mortar may be needed. In these embodiments the additional tile mortar is added in this step.

The tile leveling device is then placed in the tile mortar 304. In different embodiments the tile leveling devices are laid in different locations, such as in each corner of the tile. In different embodiments tile mortar may be added to the underside of a tile 308. In one embodiment after tile mortar is spread on the subfloor 301 tile mortar is spread on the underside of a tile 308. In another embodiment tile mortar is added to the underside of a tile 308 after the tile leveling devices are applied 304. This will ensure a total coverage of tile mortar under the tile to be laid.

Once the tile leveling devices are placed, the tile is laid in place 305 over the tile leveling devices. The tile is then leveled by lightly tapping on the tile over any necessary 306. In one embodiment after the tile is leveled more tile mortar is spread 301 and the process starts over again. In another embodiment the last tile has been laid and the project is completed 307.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A method for using a tile leveling device the method comprising:

placing at least one tile leveling device beneath a tile to be laid;

wherein the at least one tile leveling device is comprised of a material which may be reshaped using reasonable force;

placing a tile on top of the at least one tile leveling device;

leveling the tile, wherein the tile leveling device is left under the tile.

2. The method for using a tile leveling device of claim 1, the method further comprising leveling the tile by applying pressure above the at least one tile leveling device.

3. The method for using a tile leveling device of claim 1, the method further comprising applying tile mortar to a subfloor prior to placing the at least one tile leveling device.

4. The method for using a tile leveling device of claim 3, the method further comprising laying the tile over the tile mortar, before placing the at least one tile leveling device;

then checking the coverage of the tile mortar along the tile.

5. The method for using a tile leveling device of claim 1, the method further comprising placing an additional at least one tile leveling device beneath a next tile to be laid;

placing the next tile on top of the additional at least one tile leveling device.

6. The method for using a tile leveling device of claim 5, wherein the method repeats until the floor is laid and the project is complete.

7. The method for using a tile leveling device of claim 1, wherein the at least one tile leveling device is a spherical device.

8. The method for using a tile leveling device of claim 3, further comprising applying tile mortar to the underside of the tile to be laid.

9. The method for using a tile leveling device of claim 1, wherein the tile leveling device uses a color to represent the tile leveling devices' size.

10. The method for using a tile leveling device of claim 1, wherein the tile leveling device is made from a malleable metal.

11. The method for using a tile leveling device of claim 1, wherein the tile leveling device is made from a moldable plastic.

* * * * *